United States Patent [19]

Nakajima et al.

[11] 4,195,996

[45] Apr. 1, 1980

[54] METHOD OF RECORDING RADIATION IMAGE

[75] Inventors: Yosuke Nakajima, Minami-ashigara; Yoshiyuki Hoshi; Takayoshi Fukuoka, both of Fujinomiya, all of Japan

[73] Assignee: Fuji Photo Film Co., Ltd., Ashigara, Japan

[21] Appl. No.: 881,944

[22] Filed: Feb. 28, 1978

[30] Foreign Application Priority Data

Feb. 28, 1977 [JP] Japan ..... 52-21833

[51] Int. Cl.[2] ..... G03C 7/00; G03C 1/92

[52] U.S. Cl. ..... 430/380; 430/139; 430/538

[58] Field of Search ..... 96/55, 82, 87

[56] References Cited

U.S. PATENT DOCUMENTS

| | | | |
|---|---|---|---|
| 3,734,735 | 5/1973 | Borics | 96/55 |
| 3,910,793 | 10/1975 | Peisach | 96/82 |
| 3,912,933 | 10/1975 | Van Stappen | 96/82 |
| 3,955,983 | 5/1976 | Nakajima et al. | 96/55 |
| 4,028,550 | 6/1977 | Weiss et al. | 96/82 |
| 4,040,833 | 8/1977 | Hinata et al. | 96/82 |
| 4,049,454 | 9/1977 | Van Doorselaer et al. | 96/55 |

*Primary Examiner*—Travis Brown

*Attorney, Agent, or Firm*—Sughrue, Rothwell, Mion, Zinn and Macpeak

[57] ABSTRACT

A method of recording a radiation image having excellent sharpness which comprises image-wise exposing to radiation, in combination with the use of a fluorescent intensifying screen, a light-sensitive photographic element comprising a water-proof opaque support, which has an average degree of reflection of about 70 percent or greater, based on the degree of reflection of a magnesium oxide white plate being 100%, in the spectral wavelength region of from about 380 mμ to about 600 mμ, and having on only one surface thereof a coating of a green sensitized silver halide photographic emulsion containing a phenolic color coupler or an α-naphtholic color coupler, each capable of forming a quinoneimine dye having a maximum absorption within a spectral wavelength region of about 550 mμ to about 700 mμ on color development, where the silver halide grains of the emulsion have a number average grain size of about 0.5μ to about 2.2μ and are present in an amount of from about 0.5 g to about 3 g of silver per $m^2$, and then subjecting the image-wise exposed light-sensitive photographic element to a color development processing with a phenylene diamine color developing agent and without a silver-removal step.

23 Claims, 1 Drawing Figure

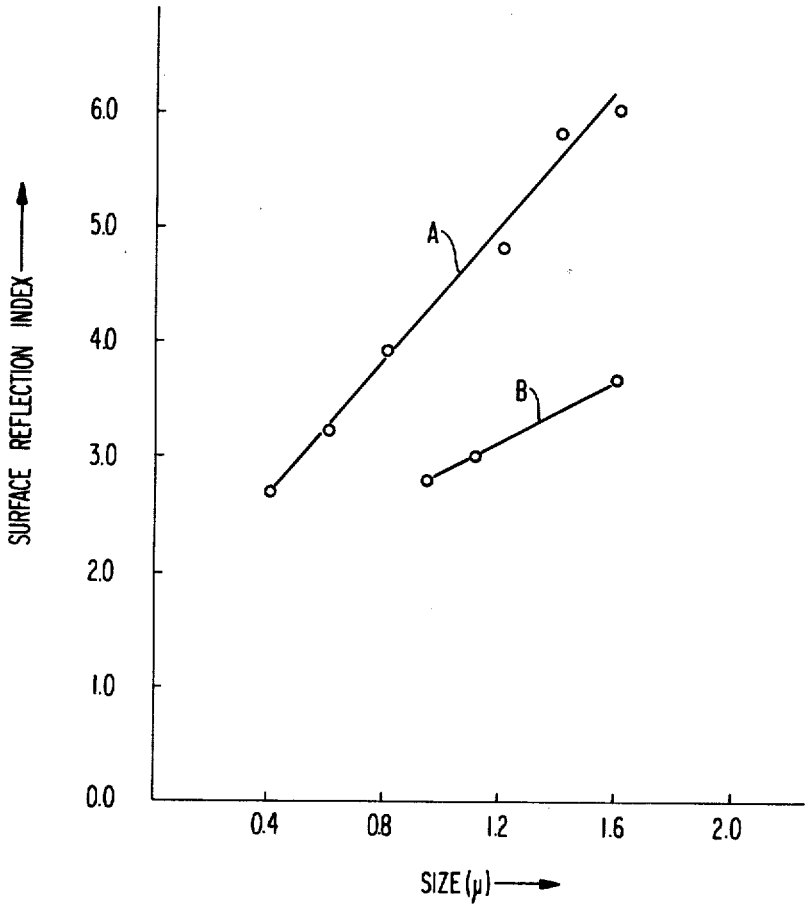
SURFACE REFLECTION INDEX
6.0
5.0
4.0
3.0
2.0
1.0
0.0
A
B
0.4
0.8
1.2
1.6
2.0
SIZE (μ)

METHOD OF RECORDING RADIATION IMAGE

BACKGROUND OF THE INVENTION

1. Field of the Invention

The present invention relates to a method of recording an image using radiation, more particularly, to a method of recording radiation to produce an image having good sharpness while maintaining the same sensitivity as is obtained with a silver halide photosensitive film coated on both sides with silver halide emulsion layers as a result of (1) minimizing the deterioration of image sharpness due to cross-over light emitted in the two silver halide photosensitive emulsion layers of the silver halide photosensitive film coated on both sides of the support, (2) compensating for the reduction in sensitivity in the film described in (1) above by use of a support having a degree of reflection of greater than a certain amount, and in addition (3) compensating for the reduction in image density with a color development processing which does not include a silver-removing step.

2. Description of the Prior Art

One of the most important factors which deteriorate the image sharpness of a silver halide photosensitive film suitable for use in radiography containing a silver halide photographic emulsion layer coated on both sides of the support (hereinafter referred to as a "both-side coated" silver halide photosensitive film suitable for use in radiography) is the "cross-over phenomenon". The cross-over phenomenon arises when a both-side coated silver halide photosensitive film is used in combination with fluorescent intensifying screens placed on both sides thereof, and is a phenomenon in which a fluorescence emitted from the intensifying screen at one side forms not only an image on the silver halide emulsion layer adjacent the intensifying screen, but also forms an unclear image on the silver halide emulsion layer located on the opposite side of the surface of a support to the first silver halide emulsion layer because a considerable amount of fluorescence passes through the support. In this connection, light which passes through a film support and subsequently forms an image on a silver halide photographic emulsion layer located on the opposite side of the film support to the surface exposed to the incident light is referred to herein as cross-over light. Cross-over light forms an unclear image because light emitted from a fluorescent intensifying screen by exposure to radiation spreads due to both refraction and diffusion reflection of light at the boundary of the intensifying screen layer and a photographic emulsion layer and a support therefor. Interruption of cross-over light is effective to increase the image sharpness of a radiation-sensitive silver halide photographic element containing a film support. On the other hand, interruption of cross-over light also eliminates light effectively used due to cross-over, which results in decreasing the sensitivity of the film to radiation (i.e., the reciprocal of the dosage necessary for obtaining a certain optical image density). Accordingly, it is not easy to remove cross-over light without reducing the sensitivity of the film to radiation.

SUMMARY OF THE INVENTION

A first object of the present invention is to provide a reflection view type "one-side coated" radiation recording element having improved image-sharpness by removing cross-over light, and, in addition to provide a substantially highly increased sensitivity by compensating for the decrease in sensitivity due to the removal of cross-over light by effectively reflecting on a support light having a wavelength to which silver halide is sensitive.

A second object of the present invention is to provide an one-side coated radiation recording element wherein a silver halide photographic emulsion layer thereof contains a color coupler which is capable of producing a quinoneimine dye having a maximum absorption in the spectral wavelength region of from about 550 mμ to about 700 mμ during color development with a p-phenylenediamine developing agent so as to produce a dye image in addition to a silver image, which results in increasing the density of the "reflection view" type image.

The above-described objects of the present invention are attained by a method of recording a radiation image which comprises image-wise exposing to radiation, in combination with the use of a fluorescent intensifying screen, a light-sensitive photographic element comprising a water-proof support, which has an average degree of reflection, based on the degree of reflection of a magnesium oxide white plate being 100%, of about 70 percent or greater in the spectral wavelength range of from about 380 mμ to about 600 mμ, and having on only one surface of the support a coating of a green sensitized silver halide photographic emulsion containing a phenolic color coupler or an α-naphtholic color coupler, each capable of forming a quinoneimine dye having a maximum absorption within a spectral wavelength region of about 550 mμ to about 700 mμ on color development, where the silver halide grains have a number average grain size of about 0.5μ to about 2.2μ and are present in an amount of from about 0.5 g to about 3 g of silver per $m^2$, and then subjecting the image-wise exposed light-sensitive photographic element to a color development processing with a phenylene diamine color developing agent and without a silver-removal step.

BRIEF DESCRIPTION OF THE DRAWING

The FIGURE is a graph which indicates the relationship between the number average grain size of silver halide grains in a photographic emulsion used and the surface degree of reflection at the area having the maximum image density obtained. In the FIGURE, (A) indicates the relationship for a radiation-recording element without a coupler, while (B) indicates the relationship for a radiation-recording element containing a coupler.

DETAILED DESCRIPTION OF THE INVENTION

The increase in sensitivity according to the method of the present invention has been achieved by effectively assisting the silver halide photographic emulsion of the photographic element to absorb light emitted from a fluorescent intensifying screen on exposure to radiation by causing a multiple reflection of the light between a reflection layer on the support and the intensifying screen to occur. In this connection, the reason why the image-sharpness is high for the amount of light used effectively is because when a conventional both-side coated photographic film is used, cross-over light passes through the transparent support having a thickness of about 180μ and then sensitizes the silver halide emulsion layer located on the opposite side of the support, whereas when multiple reflection according to the present invention is used, the spread of light is minimized due to the fact that the light passes through and returns through only a silver halide photographic emulsion layer having a thickness of about 10μ or less.

The both-side coated black and white X-ray film hitherto known has the defects that the image-sharpness is deteriorated because cross-over light increases when the amount of silver halide coated is reduced so as to reduce the amount of silver used while maintaining the sensitivity. In contrast to this, according to the recording method of the present invention the reduction in the amount of silver halide coated is connected to both a decrease in the turbidity of a photographic emulsion layer and an increase in the efficiency of multiple reflection. This results in the advantages of a decrease in the dosage for exposure to radiation and a minimized deterioration in image-sharpness. This fact demonstrates that the recording method of the present invention is a recording method suitable for the conservation of silver. On the other hand, in order to minimize the dosage for exposure to radiation, a system which comprises a combination of a green light-emitting intensifying screen containing a rare earth element and an orthochromatic film capable of being sensitized to green light has been developed. However, in the system cross-over light increases so that the image-sharpness tends to deteriorate, because the intrinsic absorption of silver halide ranges into the blue light region and the silver halide lacks the ability to absorb in the green light region. The above-described system, when used in combination with the present invention, provides a radiation image-recording element in which the image-sharpness is improved and the dosage for exposure to radiation is minimized. This is because of the increase in the multiple reflection efficiency due to the use of green light, since the emulsion layer greatly absorbs blue light rather than green light.

In addition, an image which is to be viewed by reflected light ("reflection view" type image) is generally inferior to an image which is to be viewed by transmitted light ("transmission view" type image) in terms of the small difference between the lower image density areas and the higher image density areas. However, where an image is composed of a dye in addition to silver, the difference in the density thereof is enlarged as compared to that of the image composed only of silver. As to an image composed only of silver, the maximum density of a "reflection view" type image markedly decreases, which is accompanied by a deterioration in granularity, as the grain size of the silver halide in a photographic emulsion increases. On the other hand, these defects are small in an image composed of silver and a dye, even though large silver halide grains are used. The discovery of these phenomena is important in preventing both a reduction in maximum density and a degradation of granularity, in a "reflection view" type one-side coated radiation-recording element and moreover in producing a "reflection view" type one-side coated radiation-recording element which exhibits a sensitivity equal to or higher than that of a "transmission view" type both-side coated radiation-recording element.

An increase in the image density of a "reflection view" type image and an enlarging of the range of density which can be distinguished visually correspond, from a physical view point, to a reduction in the surface degree of reflection at the area having a maximum image density.

The drawing shows the relationship between the surface degree of reflection at the area having a maximum image density and the number average grain size of the silver halide grains used in a photographic emulsion. Moreover in the drawing, the abscissa shows the number average grain size of the silver halide grains in microns, while the ordinate is a relative value in terms of percent of the surface reflection index, assuming that the surface degree of reflection obtained by measuring a white plate containing magnesium oxide (i.e., as described in NBS Letter Circular LC-547) with light having a wavelength of 550 Mμ is 100 percent. The straight line (A) indicates the range of the surface degree of reflection at the area having a maximum image density which was obtained by preparing a recording element using a variety of photographic emulsions without any coupler while varying the number average grain size of the silver halide grains used exactly according to the method of producing Recording Element VII as described in Example 3 given hereinafter, and then subjecting the thus-prepared recording element to development processing after exposure to radiation. The straight line (B) indicates the range of the surface degree of reflection at the portion having a maximum image density which was obtained in the same manner as that for straight line (A) except for preparing a recording element containing a coupler exactly according to the method of producing Recording Element I as set forth in Example 1 given hereinafter.

A variety of ingredients can be used in the present invention and examples thereof are illustrated below in order.

Generally, the silver halide photographic emulsion which is used in the present invention can be prepared by mixing an aqueous solution of a water-soluble silver salt (for example, silver nitrate) and an aqueous solution of a water-soluble halide (for example, potassium bromide) in the presence of an aqueous solution of a water-soluble high molecular weight compound such as gelatin. Silver chloride, silver bromide and mixed silver halides such as silver chlorobromide, silver iodobromide or the like can be used as the silver halide. Silver iodobromide containing about 10 mol percent or less of silver iodide is preferred. The crystal form of these silver halide grains can be that of a cubic system, a hexagonal system, a mixture thereof and the like. The grain size of the silver halide used does not have to be uniform.

Known or conventional processes can be employed for preparing the silver halide grains. The silver halide grains can be advantageously produced using a single jet process, a double jet process, a controlled double jet process or the like.

In addition, two or more types of silver halide photographic emulsions which have been prepared separately can be mixed and used if desired.

Moreover, the crystal structure of the silver halide grains may have a uniform structure throughout the grains, may have a layered structure wherein the outer portion and the inner portion thereof differ, or may be the so-called "conversion" type structure grains as disclosed in British Pat. No. 635,841 and U.S. Pat. No. 3,622,318. Still further, the silver halide may be those of the surface latent image type or the internal latent image type. These photographic emulsions are described in references such as C. E. K. Mees & T. H. James, *The*

*Theory of the Photographic Process*, 3rd Ed., Macmillan Co., New York (1966), P. Glafkides, *Chimie Photographique*, 2nd Ed., Photocinema Paul Montel, Paris (1957) and the like, and can be prepared using an ammoniacal process, a neutral process, an acidic process and the like as is conventionally used.

In order to remove by-product water-soluble salts (for example, potassium nitrate where silver bromide has been produced by reacting silver nitrate with potassium bromide) from the reaction system, the thus-formed silver halide grains are washed, and then subjected to a ripening in the presence of a chemical sensitizing agent such as sodium thiosulfate, N,N,N'-trimethylthiourea, a thiocyanato aurate complex salt, a thiosulfonato aurate complex salt, stannous chloride, hexamethylene tetramine or the like, so that the sensitivity of the photographic emulsion can be increased without coarsening the silver halide grains. These processes are described in Mees & James, supra and Glafkides, supra.

Examples of hydrophilic colloids which can be used as a binder for the silver halide include gelatin, colloidal albumin, casein, cellulose derivatives such as carboxymethylcellulose and hydroxyethylcellulose, saccharide derivatives such as agar-agar, sodium alginate, and starch derivatives, and synthetic hydrophilic colloids such as polyvinyl alcohol, poly-N-vinyl pyrrolidone, copolymers of acrylic acid with another monomer, polyacrylamide, and the partially hydrolyzed products thereof. If desired, compatible mixtures of two or more of these colloids may be used.

Of these colloids, gelatin is most commonly used. The gelatin may be partially or completely replaced by synthetic polymers or by gelatin derivatives, i.e., gelatin modified by an agent having a functional group capable of reacting with a functional group present in the gelatin molecule such as an amino group, an imino group, a hydroxy group and a carboxy group; or a graft polymer of gelatin grafted with chains of other high molecular weight materials.

Examples of the above-described agents which can be used for producing gelatin derivative are isocyanates, acid chlorides and acid anhydrides as described in U.S. Pat. No. 2,614,928; acid anhydrides as described in U.S. Pat. No. 3,118,766; bromoacetic acids as described in Japanese Patent Publication 5514/1964; phenylglycidyl ethers as described in Japanese Patent Publications 26845/1967; vinyl sulfone compounds as described in U.S. Pat. No. 3,132,945; N-arylvinylsulfonamides as described in British Pat. No. 861,414; maleinimide compounds as described in U.S. Pat. No. 3,186,846; acrylonitrile as described in U.S. Pat. No. 2,594,293; polyalkylene oxides as described in U.S. Pat. No. 3,312,553; epoxy compounds as described in Japanese Patent Publication 26845/1967; esters as described in U.S. Pat. No. 2,763,639; and alkanesultones as described in British Pat. No. 1,033,189.

Examples of high molecular weight compounds whose chains can be grafted to gelatin are described in U.S. Pat. Nos. 2,763,625, 2,831,967 and 2,956,884; *Polymer Letters*, 5, 595(1967); *Phot. Sci. Eng.*, 9, 148(1965), *J. Polymer Sci.*, A-1, 9, 3199(1971); or the like. Examples include polymers or copolymers of vinyl compounds such as acrylic acid, methacrylic acid or the derivatives thereof such as esters, amides, nitriles, etc., or styrene. Of these polymers, hydrophilic vinyl polymers having some degree of compatibility with gelatin, such as homo- or co-polymers of acrylic acid, acrylamide, methacrylamide, hydroxyalkyl acrylates, hydroxyalkyl methacrylates, etc. are particularly useful.

The above-described silver halide photographic emulsion can be further chemically sensitized using conventional techniques. Examples of suitable chemical sensitizers include gold compounds such as chloroaurate complex salt and gold (III) trichloride as described in U.S. Pat. Nos. 2,399,083, 2,540,085, 2,597,856, and 2,597,915, salts of noble metals such as platinum, palladium, iridium, rhodium and ruthenium as described in U.S. Pat. Nos. 2,448,060, 2,540,086, 2,566,245, and 2,598,079; sulfur compounds capable of reacting with silver salts to form silver sulfide, as described in U.S. Pat. Nos. 1,574,944, 2,410,689, 3,189,458, and 3,501,313; and reducing materials including stannous salts, amines and the like, as described in U.S. Pat. Nos. 2,487,850, 2,518,698, 2,521,925, 2,521,926, 2,694,637, 2,983,610, and 3,201,254.

The above-described photographic emulsion can contain a stabilizing agent, an antifogging agent, a surface active agent, a hardening agent and a development accelerating agent. A variety of compounds can be added to the photographic emulsion so as to prevent both a reduction in sensitivity and a formation of fog during their production, during storage or during development processing of the photosensitive element. Many of these compounds have long been known and examples include heterocyclic compounds, mercury-containing compounds, mercapto compounds, metal salts, and phenols, including 4-hydroxy-6-methyl-1,3,3a,7-tetrazaindene, 3-methyl-benzothiazole, 1-phenyl-5-mercaptotetrazole, dihydroxybenzene, and dihydroxynaphthol.

Some examples of these compounds which can be used are described in C. E. K. Mees & T. H. James, *The Theory of the Photographic Process*, 3rd Ed., Macmillan Co., (1966) and the original literature references cited therein and in addition in the following patents: U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,697,099, 2,708,162, 2,728,663, 2,728,664, 2,728,665, 2,476,536, 2,824,001, 2,843,491, 2,886,437, 3,052,544, 3,137,577, 3,220,839, 3,226,231, 3,236,652, 3,251,691, 3,252,799, 3,281,135, 3,326,681, 3,420,668, and 3,622,339. British Pat. Nos. 893,428, 403,789, 1,173,609 and 1,200,188.

The photographic emulsion can contain surface active agents, individually or as a mixture thereof. The surface active agents are used as a coating aid, for improving emulsification, sensitization, or photographic properties, for imparting antistatic or anti-adhesion properties and for other purposes.

These surface active agents can be classified as natural surface active agents such as saponin; nonionic surface active agents such as alkylene oxide type, glycerin type, glycidol type or other type compounds; cationic surface active agents such as higher alkylamines, quaternary ammonium salts, pyridine or other heterocyclic compounds, phosphonium or sulfonium compounds and the like; anionic surface active agents containing an acidic group such as a carboxylic acid group, a sulfonic acid group, a phosphoric acid group, a sulfuric ester group, a phosphoric ester group or the like; and amphoteric surface active agents such as amino acids, aminosulfonic acids, sulfuric or phosphoric esters of aminoalcohols, or the like.

Some examples of these surface active agents which can be used are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, and 3,545,974, West German Patent application (OLS) 1,942,665, British Pat. Nos. 1,077,317 and 1,198,450, as well as in references such as Ryohei Oda, et al., *Kaimenkasseizai no Gosei to Sono Oyo (Synthesis of Surface Active Agents and their Applications)*, Maki Publisher (1964), A. W. Schwartz et al, *Surface Active Agents*, Interscience Publications Inc. (1958), and J. P. Sisley et al, *Encyclopedia of Surface Active Agents*, vol. 2, Chemical Publishing Company (1964).

The photographic emulsion can be hardened using conventional methods. Examples of suitable hardening agents include aldehyde type compounds such as formaldehyde, and glutaraldehyde; ketone compounds such as diacetyl, and cyclopentanedione; active halogen-containing compounds such as bis(2-chloroethylurea), 2-hydroxy-4,6-dichloro-1,3,5-triazine and other compounds as described in, e.g., U.S. Pat. Nos. 3,288,775 and 2,732,303 and British Pat. Nos. 974,723 and 1,167,207; active olefin-containing compounds such as divinyl sulfone, 5-acetyl-1,3-diacryloylhexahydro-1,3,5-triazine, and other compounds as described in, e.g., U.S. Pat. Nos. 3,635,718, and 3,232,763, and British Pat. No. 994,869; N-methylol compounds such as N-hydroxymethylphthalimide and other compounds as described in e.g., U.S. Pat. Nos. 2,732,316 and 2,586,168; isocyanates described in, e.g., U.S. Pat. No. 3,103,437; aziridine compounds as described in, e.g., U.S. Pat. Nos. 3,017,280 and 2,983,611; acid derivatives as described in, e.g., U.S. Pat. Nos. 2,725,294, and 2,725,295; carbodiimide type compounds as described in, e.g., U.S. Pat. No. 3,100,704; epoxy compounds as described in, e.g., U.S. Pat. No. 3,091,537; isooxazole type compounds as described in U.S. Pat. Nos. 3,321,313, and 3,543,292; halocarboxyaldehydes such as mucochloric acid; dioxane derivatives such as dihydroxydioxane and dichlorodioxane; and inorganic hardening agents such as chromium alum and zirconium sulfate.

In addition to the above-described compounds, precursors thereof such as alkali metal bisulfite-aldehyde adducts, methylol derivatives of hydantoin and primary aliphatic nitroalcohol can be used.

Suitable examples of supports which can be used in the present invention include a water-proof support wherein a water-proof polyolefin resin layer, e.g., a polyethylene layer, a polypropylene layer, etc., is each coated on both surfaces of a paper base and a white pigment is added to the above-described resin layer where a photographic emulsion is to be coated thereon, for the purpose of imparting to the support, a degree of reflection of about 70 percent or greater, preferably 75 percent or greater, to light having a wavelength of from about 380 mμ to about 600 mμ. Examples of white pigments which can be incorporated in the polyolefin resin layer include titanium oxide and zinc oxide. In addition, zinc sulfate, calcium sulfate, aluminum oxide, silicon oxide, barium sulfate or the like can be used in combination therewith.

Furthermore, a water-proof support which can be used in the present invention can be prepared by milling the above-described white pigment into a thermoplastic resin such as polyethylene, polypropylene, ethylene-vinyl acetate copolymers, polyethylene terephthalate, cellulose acetate, polyvinyl chloride and the like and then coating the thus obtained dispersion onto a transparent polymer support in order to achieve a degree of reflection of about 70 percent or greater to light having a wavelength of from about 380 mμ to about 600 mμ for the support.

A polyolefin support is preferred for use in this invention.

Another example of the support comprises a support wherein a finely divided powder of a white pigment is incorporated in a resin composed of a styrene-type resin as a main component. Examples of suitable styrene-type resins include homopolymers and copolymers each composed of styrene as a primary ingredient (which does not necessarily mean a major ingredient) such as styrene homopolymer, impact resistant polystyrene, acrylonitrile-styrene copolymers, acrylonitrile-styrene-butadiene copolymers, methyl methacrylate-styrene copolymers, α-methylstyrene homopolymer, copolymers of α-methylstyrene with another monomer copolymerizable therewith, or the like. At least one of these styrene type resins is used when the support is produced.

In addition, where the resin is a mixture of different types of resins, examples of synthetic resins other than the styrene-type resin which can be present in the mixture include ethylene-vinyl acetate copolymers, ethylene-acrylate copolymers, ethylene-methacrylic acid ionomers, ethylene-acrylic acid ionomers, butadiene-acrylonitrile copolymers, ethylene-propylene copolymers, natural rubber, synthetic isoprene rubber, butadiene rubber, styrene-butadiene rubber, high styrene rubber, polybutadiene, chloroprene, polybutene, butyl rubber, and a variety of nitrile rubbers. When a support is manufactured, at least one of these synthetic resins can be mixed with the above-described styrene-type resin.

On the other hand, examples of fine grained powders of a white pigment to be incorporated in the above-described resin include titanium dioxide, zinc oxide, calcium sulfate, barium sulfate, calcium carbonate, and lithopone.

Another example of the support comprises a support composed of a polymer having a roughened and whitened surface. Typical examples of these polymers include polystyrene, polyesters, polyolefins, polyamides, polycarbonates, polyvinyl chloride, cellulose acetate type resins, polyacetals, and the like.

A surface roughening method for a polymer (support) which comprises the steps of contacting a polymer with an organic solvent or a swelling agent therefor so as to swell the surface thereof and then contacting the swollen surface with water or an organic solvent compatible with the solvent used to swell the surface; a surface-roughening method using mechanical friction; a surface-roughening method using a support containing a blowing agent which is capable of generating a gas on heating, which results in the entire support becoming slightly opaque; a surface-roughening method which comprises the steps of incorporating a different material from the polymer into the polymer which is to be used for a support, forming the support from the mixture, and then selectively dissolving the additive out of the support formed; and the like; can be used as surface-roughening methods.

In addition, the resin for a support can contain white pigments such as titanium dioxide, barium sulfate, calcium sulfate, barium carbonate, lithopone, alumina white, calcium carbonate, and silica white.

In all of the above-described embodiments, a suitable amount of the white pigment is about b 1 to 30% by weight, preferably 5 to 20% by weight, per unit weight of the polymer resin.

When a support composed of such a roughened and whitened polymer is used, a radiation image having superior image sharpness can be obtained due to reduced light dispersion on multiple reflection, as compared to the use of a styrene type resin support containing a white pigment, or a paper or transparent polymer support coated with a polyolefin composition containing a white pigment.

The color photographic dye image which is obtained by the present invention preferably is a cyan dye image or a blue dye image having a primary absorption within the red wavelength region (about 600 nm to about 700 nm) and the green wavelength region (about 550 nm to about 600 nm) of the visible spectrum.

For this purpose, a phenol type or α-naphthol type color coupler which is able to form a quinoneimine dye having a maximum absorption within a spectral wavelength region of about 550 nm to about 700 nm on color development of the silver halide with an organic p-phenylene diamine developing agent following exposure to light is particularly preferred as a color coupler.

Suitable couplers having these characteristics have the following general formulas (I) to (III):

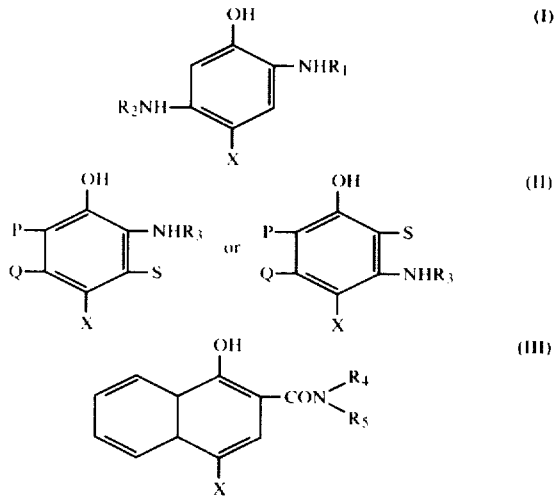

wherein $R_1$, $R_2$ and $R_3$, which may be the same or different, each represents an aliphatic carboxylic acyl group having 2 to 25 carbon atoms, which may be substituted; an aromatic carboxylic acyl group having 7 to 30 carbon atoms which may be substituted; a heterocyclic carboxylic acyl group having 2 to 25 carbon atoms and 1 to 5 nitrogen atoms, oxygen atoms and sulfur atoms as hetero atoms in the heterocyclic ring moeity which may be substituted with one or more substituents, examples of which include a 2-furoyl group and a 2-thienoyl group; an aliphatic sulfonic acyl group having 1 to 25 carbon atoms, which may be substituted; an aromatic sulfonic acyl group having 6 to 30 carbon atoms which may be substituted; a sulfonylthienyl group; or a substituted aliphatic carboxylic acyl group wherein the substituent is a substituted or unsubstituted aryloxy group having 7 to 30 carbon atoms. Suitable representative examples of groups for $R_1$, $R_2$ and $R_3$ include a tetradecanoyl group, a 2,4-di-tert-amyl-phenoxyacetyl group, an α-(2,4-di-tert-amyl-phenoxy)butyryl group, a heptafluorobutyryl group, a β-carboxypropionyl group, etc.

$R_4$ and $R_5$, which may be the same or different, each represents a hydrogen atom, an unsubstituted or substituted aryl group having 6 to 30 carbon atoms, or an unsubstituted or substituted alkyl group having 1 to 25 carbon atoms. Suitable representative examples of groups for $R_4$ and $R_5$ include a methyl group, an octyl group, a dodecyl group, a 2-tetradecyloxyphenyl group, a 3-hexadecyloxycarbonylphenyl group, etc.

P, Q and S, which may be the same or different, each represents a hydrogen atom, a halogen atom, or an unsubstituted or substituted alkyl group having 1 to 10 carbon atoms. Suitable examples of substituents for P, Q and S include a methyl group, a chlorine atom, etc.

X represents a substituent which is capable of being released when the color coupler couples with the oxidation product of a primary color developing agent, such as a hydrogen atom and a halogen atom (e.g., a chlorine atom); a development inhibitor releasable group as described in Japanese Patent Applications (OPI) 2328/1972 and 3480/1972; or a dye group such as an azo dye, an azomethine dye, an indoaniline dye, an indophenol dye, or an anthraquinone dye.

Phenol type ortho- and meta-diamido couplers of the type (I) are described in, for example, U.S. Pat. Nos. 2,772,162, 3,222,176, and 3,758,308. Phenol type ortho- or meta-amido couplers of type (II) are described in, for example, U.S. Pat. No. 3,737,318, and Japanese Patent application No. 4480/1972. α-Naphthol type couplers of type (III) are described in, for example, U.S. Pat. Nos. 3,591,383, and 3,476,563, and British Pat. Nos. 1,201,110, 1,038,331, 727,693, and 747,628.

Suitable couplers which can be used in this invention are also disclosed in U.S. Pat. Nos. 2,474,293, 2,908,573, 2,698,794, Japanese Patent application No. (OPI) 69329/1977 (corresponding to U.S. Ser. No. 747,855, filed Dec. 6, 1976). Since a preferred embodiment of this invention lies in its use in recording X-rays, the couplers disclosed in Japanses Patent application (OPI) 69329/1977 are preferred.

A suitable amount of the color coupler which can be used in this invention is about 0.1 to about 1 mol, preferably $\frac{1}{4}$ to $\frac{1}{8}$ mol, per mole of the silver halide.

The above-described couplers include oleophilic couplers suitable for use in the "oil dispersion process" and hydrophilic couplers suitable for use in the "aqueous alkaline dispersion process". In the "oil dispersion process", a solution of the oleophilic coupler dissolved in an organic solvent is directly dispersed in a photographic emulsion or an aqueous gelatin solution as finely divided colloidal particles, or alternatively a solution which comprises a dispersion of the above-described coupler solution in an aqueous medium is added to a photographic emulsion or an aqueous gelatin solution. The coupler which is subjected to the "oil dispersion process" forms oil droplets with an organic solvent for dispersion. The size of these oil droplets is preferably as small as possible in size, i.e., to have as large as possible a surface area.

Essential materials used for the "oil dispersion process" and optional materials for the dispersion include a surface active agent, gelatin, an organic solvent, additives and the like. A specific example of an anionic surface active agent which may be used comprises using a salt of an alkyl sulfonic acid, a salt of an alkylbenzene sulfonic acid, a salt of an alkyl sulfate, a salt of an alkyl carboxylic acid, Gardinol W A (tradename; sulfated coconut fatty alcohol manufactured by E. I. du Pont de Nemours Co., Inc.) (as described in U.S. Pat. No. 2,332,027), a salt of triisopropylnaphthalene sulfate (as disclosed in U.S. Pat. No. 2,332,207), Alkanol B (sodium triisopropylnaphthalene sulfonate) (as disclosed in U.S. Pat. No. 2,801,170), or a water-soluble coupler having both a sulfonic or carboxyl group and a long chain aliphatic group (as disclosed in Japanese Pat. No. 428,191) as an emulsifying agent.

A wide variety of types of gelatin such as acid processed gelatin, lime processed gelatin and enzyme processed gelatin can be used as the gelatin. Gelatin having an average molecular weight of not less than about 30,000 in particular is suitable for use in fine emulsification. In addition, modified gelatins such as acylated gelatins can be used.

It is essential for the oil-soluble coupler to be melted by heating or dissolved in an organic solvent. Couplers which can be directly emulsified by melting are those couplers having a melting point of about 90° C. or less.

An organic liquid which is substantially insoluble in water and has a boiling point of about 190° C. or higher under atmospheric pressure is preferred as a coupler solvent used for finely dispersing an oil-soluble coupler in an aqueous medium.

Specific examples of these organic solvents include carboxylic esters, tricresyl phosphate, tri-n-butyl phosphate, diisooctyl phthalate, tri(isooctyl) phosphate, dibutyl phthalate, dimethoxyethyl phthalate, N,N-diethylcaprylamide, dibutyl adipate, tributyl citrate, butyl m-pentadecylphenyl ether, butyllaurate, ethyl 2,4-di-tert-butylphenyl ether.

In order to dissolve a coupler, it is sometimes advantageous to use a low boiling point solvent or a water-soluble high boiling point solvent in combination with the above-described solvent(s). Specific examples of such high boiling point solvents include propylene carbonate, cyclohexanone, ethyl acetate, dimethylformamide, butyl acetate, diethylsulfoxide, ethyl propionate, methyl Cellosolve, butyl alcohol, and tetrahydrofuran.

If desired, the dispersion containing an organic solvent can contain an ultraviolet light absorbing agent, an antioxidant, an antifogging agent, a primary developing agent, a auxiliary developing agent and a development-accelerating agent in addition to the oil-soluble coupler.

Device which produces a great shearing force or a high intensity ultrasonic energy to a processing solution is suitable for emulsifying. A colloid mill, a homogenizer, a capillary tube type emulsifying apparatus, and an emulsifying apparatus provide excellent results in particular in emulsification.

The following method is known as a method of dispersing a water-soluble coupler.

To an aqueous composition containing hydrophilic colloids is added an aqueous solution of a coupler having at least one ballast group such as a long chain aliphatic group, e.g., an alkyl group and an alkylene group each having 5 to 20 carbon atoms, and at least one water solubilizing group such as a carboxyl group and a sulfo group, the alkali metal salt of which imparts hydrophilicity and water-solubility to the coupler.

More specifically, the above-described coupler is dissolved into a solution of an alkali metal hydroxide in water or in an aqueous alcohol. After that, the thus-obtained solution is directly added to a photographic emulsion, or alternatively is added to a hydrophilic colloid composition, for example, an aqueous solution of a hydrophilic colloid or a melted gel containing a hydrophilic colloid and then the obtained solution is added to a photographic emulsion.

The fluorescent intensifying screen which is used with a radiation-sensitive photographic element ordinarily contains calcium tungstate, lead/barium sulfate, or calcium tungstate/barium sulfate as a fluorescent substance. A fluorescent intensifying screen which emits radiation predominately in the wavelength region of about 410 nm or longer and contains a fluorescent substance radiating primarily in the green region is also used advantageously.

A green light-emitting intensifying screen preferably contains a fluorescent substance such as a rare earth element having an atomic number of 39 or from 57 to 71, of which examples include yttrium, gadolinium, lanthanum, and cerium, as described in Japanese Patent applications (OPI) 55730/1973 (corresponding to U.S. Pat. Nos. 3,809,906), 52990/1974 and 63424/1974 (corresponding to British Pat. No. 1,414,456).

Suitable fluorescent intensifying screens which can be used in this invention are commercially available and detailed descriptions of fluorescent intensifying screens, including green light-emitting fluorescent intensifying screens, are set forth in U.S. Pat. No. 3,725,704.

An X-ray technician can use X-rays in a substantially lowered amount, when a radiation-sensitive element which comprises a support having thereon a photographic emulsion spectrally sensitized to light within the wavelength region of from about 480 nm to about 600 nm is used in combination with the above-described green light-emitting intensifying screen.

When a green light-emitting intensifying screen is used, a silver halide photographic emulsion for the radiation-sensitive photogrpahic element is spectrally sensitized within the wavelength region of from about 480 nm to about 600 nm. It is preferred for the wavelength of maximum spectral sensitivity thus obtained to be in the range of 520 nm to 560 nm.

The photographic emulsion can be spectrally sensitized or supersensitized with cyanine dyes such as a cyanine dye, a merocyanine dye and a carbocyanine dye, individually or in combination, or alternatively with a combination of the above-described cyanine dye(s) and a styryl dye or the like.

Spectral sensitization is well known, and methods which can be advantageously used are described in, e.g., U.S. Pat. Nos. 2,688,545, 2,912,329, 3,397,060, 3,615,635, and 3,628,964, British Pat. Nos. 1,195,302, 1,242,588, and 1,293,862, West German Pat. application Nos. (OLS) 2,030,326, and 2,121,780, Japanese Patent Publication Nos. 4936/1968, and 14630/1969. The amount of sensitizing dye used ranges from about 10 mg to about 3000 mg, preferably from 20 mg to 1000 mg, per mol of silver halide.

Spectrally sensitizing dyes suitable for silver halide to be used in combination with an intensifying screen which emits light having a wavelength of about 480 nm to about 570 nm are described in Japanese Patent Publication 14030/1969, Japanese Patent applications (OPI) Nos. 33626/1972, and 59383/1973.

When a silver halide photographic emulsion is subjected to a development processing under an ordinary red safety light for a dark room, the photographic emulsion should be spectrally sensitized so that the sensitivity of the emulsion to the safety light is as low as possible. If desired, it is preferred to incorporate in the photographic emulsion a densensitizing dye which selectively acts to decrease the sensitivity to the safety light.

Each of the layers of the light-sensitive photographic element of this invention can be coated using a variety of coating methods including dip coating, air knife coating, curtain coating and extrusion coating using a hopper as described in U.S. Pat. No. 2,681,294.

If desired, two or more layers can be coated at the same time using the method as described in, for example, U.S. Pat. Nos. 2,761,791, 3,508,947, 2,941,898, and 3,526,528.

The above disclosure has been basically directed to the use of the light-sensitive element of this invention as an X-ray recording element. However, this is merely exemplary and should not be considered limiting. Basically any electromagnetic radiation having a wavelength of about $10^{-6}$ cm or less, e.g., X-rays, $\gamma$-rays, etc. can be used for exposure.

After exposure, the process used in the present invention involves the development of an exposed, e.g., using X-rays, $\gamma$-rays, light-sensitive material, and then fixing without any silver-removal step.

The process used in the present invention for treatment of exposed light-sensitive materials corresponds to conventional processing, for example, color development in a developing solution containing a p-phenylene diamine developing agent, the oxidation product of which couples with a color coupler contained in the silver halide emulsion, from which a silver-removal step is omitted from the conventional development processing. Such a process is described in British Pat. No. 1,358,635.

The color developing solution which can be used in the present invention is an aqueous alkaline solution containing a color developing agent which is capable of forming a dye image, according to the pattern of the silver image obtained by development on exposure by the coupling reaction of a coupler and an oxidation product of the primary color developing agent imagewise obtained in the exposed area by development of the exposed silver halide.

Generally, the color developing solution contains a developing agent, a preservative, an antifogging agent, an alkali bufferring agent, a sequestering agent, and other ingredients such as a development accelerating agent and a auxiliary developing agent.

Known aromatic primary amines such as p-phenylenediamines can be used as a primary color developing agent. Suitable examples of p-phenylenediamines, which can be used include unsubstituted p- or o-phenylenediamines and substituted phenylenediamines wherein the hydrogen atom(s) of one amino moiety is (or are) substituted with one or two substituents optionally containing therein a bond such as an ether bond, an ester bond and an amido bond, of which examples include an alkyl group, a hydroxyalkyl group, a carboxyalkyl group, an acyloxyalkyl group, an alkoxycarbonyl group, an alkyloxoalkyl group, an alkanesulfonamidoalkyl group, a cycloalkyl group, and a haloalkyl group. In addition, the above-described amino group may form a part of a 5- or 6-membered saturated or unsaturated ring such as a piperidine, piperazine, pyrrolidine, morpholine, dihydroindole, tetrahydroquinoline, or tetrahydroisoquinoline ring.

Specific examples of phenylenediamines, which can be used include N,N-dimethyl-p-phenylenediamine, N,N-diethyl-p-phenylenediamine, 4-(N-ethyl-N-$\beta$-hydroxyethyl)aminoaniline, 4-(N-ethyl-N-$\beta$-hydroxyethyl)-2-methylaniline, 4-(N-ethyl-N-$\beta$-methylsulfonamidoethyl)amino-2-methylaniline, 4-(N,N-diethyl-)amino-2-methylaniline, N,N-diethylamino-2-ethoxyaniline, 2,3-dihydro-5-amino-N-methylsulfonamidoethylindole and the like.

The developing solution can contain alkali metal sulfites or hydroxylamines as described in U.S. Pat. No. 2,286,662 as a preservative; alkali metal bromides, alkali metal iodides nitrobenzimidazoles as described in U.S. Pat. Nos. 2,496,940 and 2,656,271, mercaptobenzimidazole, 5-methylbenztriazole, 1-phenyl-5-mercaptotetrazole or the like as an antifoggant, alkali metal or ammonium hydroxides, carbonates, phosphates, or borates as an alkali bufferring agent for pH control; sodium hexametaphosphate or EDTA as a sequestering agent for metal ions; pyrazolidones, pyrazolines, aminophenols, substituted phenylenediamines, substituted hydroquinones, Weitz radicals, oxidation-reduction indicators, or the like as described in, for example, L. F. A. Mason, *The Journal of Photographic Science*, vol. 11, p 136 to 139 (1963) and G. F. Van Veelen, *The Journal of Photographic Science*, vol. 20, p 94 to 106 (1972) as a auxiliary develping agent; or a variety of pyridinium compounds or other cationic compounds as described in, for example, U.S. Pat. Nos. 2,648,604 and 3,671,247, potassium nitrate, sodium nitrate, polyethylene glycol condensate and the derivatives thereof, nonionic compounds such as polythioethers including, as a typical example, the compounds as described in British Pat. Nos. 1,020,033, and 1,020,032, polymer compounds having a sulfite ester group including, as a typical example, the compounds as described in U.S. Pat. No. 3,068,097, organic amines such as pyridine and ethanolamine, benzyl alcohol, hydrazines or the like as a development accelerating agent.

If desired, a color coupler, a competitive coupler, a thickener, an antifading agent or the like can be further added to the developer.

Generally, the pH of the developing solution is maintained in the alkaline region of from about 9.0 to about 13.0 due to the dissociation constant of the coupler used and the activity of the developing agent incorporated therein.

Detailed description of these matters is given in C. E. K. Mees & T. H. James, *The Theory of the Photographic Process*, 3rd Ed. p 278 to 311, Macmillan Company, New York (1966).

A fixing solution is an aqueous solution containing a fixing agent and specific examples of suitable fixing agents include sodium thiosulfate, ammonium thiosulfate, potassium cyanide, ammonium thiocyanate, thiourea, sodium sulfite and the like. Of these compounds, sodium thiosulfate and ammonium thiosulfate are preferred. In addition, these compounds can be used as a mixtue thereof, if desired.

The amount of the fixing agent used can be suitably varied depending upon the fixing capability, the fixing rate, the solubility of the fixing agent, and the stability of the fixing solution. Sodium sulfite, potassium metabisulfite and the like can be used as a stabilizing agent for the fixing solution. Generally, sodium sulfite is preferred. The stability is improved as the amount of the stabilizing agent used is increased, however, the stabilizing agent used should be suitably controlled to the amount thereof by which a satisfactory effect in practice can be obtained.

Generally, various kinds of hardening agents are added to the fixing solution. An $Al^{3+}$-containing compound such as aluminum chloride, aluminum sulfate, potassium alum and the like, or a $Cr^{3+}$-containing compound such as chromium alum and the like can be added to the fixing solution as a hardening agent. Where these ions are added thereto, the hardening effect obtained is increased as the pH of the solution used is reduced.

Where a thiosulfate salt is used as a fixing agent, a hydrogen sulfite salt which is capable of preventing a decomposition of the thiosulfate salt is preferably also used. Acetic acid or the like can be added to the fixing solution in order to prevent an increase in the pH due to developing solution brought thereinto with a film. In addition, it is advantageous to use a fixing solution to which boric acid is added so as to provide a pH of about 4.5 or less, because aluminum ions form a precipitate of aluminum hydroxide when the pH of the fixing solution containing aluminum ions increases to about 4.2 or greater.

On the other hand, using a high pH fixing (i.e., a pH of about 6 or higher) in which the image density obtained by the present invention is further effectively increased, an advantage is also obtained in that an organic hardening agent such as aldehyde type hardening agents, triazine type hardening agents and the like exhibits a satisfactory hardening effect. In addition, a variety of organic acids such as tartaric acid, citric acid, lactic acid, glacial acetic acid, etc. and boric acid, and the like can be used as a stabilizing agent for the high pH fixing solution. Preferred acids are boric acid and glacial acetic acid in particular.

Various kinds of salts can be used as a pH bufferring agent. Generally, acetate salts and borate salts, such as sodium acetate and sodium borate, can be used in the range of from a low pH to about neutrality, whereas carbonate salts such as sodium carbonate can be used in the high pH region. Further, in order to accelerate the development-stopping effect achieved with a fixing solution having a pH of about 6 or higher, a variety of development inhibitors such as mercapto type compounds, benzotriazole, 5-nitrobenzimidazole, 5-nitroindazole, and potassium bromide; a scavenger for the oxidation product of a color developing agent such as H acid; a preservative for the primary color developing agent; or the like; can be also added to the fixing solution. Still further, ammonium salts such as ammonium chloride can be added thereto as a fixing accelerating agent.

Suitable processing temperatures which can be used in the method of the present invention range from about 20° C. to about 60° C., preferably 30° C. to 40° C. The processing time advantageously ranges from about 10 seconds to about 90 seconds, particularly, from about 15 seconds to about 60 seconds.

Some of the effects which can be obtained by the present invention are summarized below.

(1) An excellent radiation image having increased image sharpness due to removal of cross-over light, when compared to a "transmission view" type both-side coated film can be obtained.

(2) About twice the sensitivity is obtained because the effective amount of exposure to radiation is increased due to a multiple reflection between the fluorescent intensifying screen and the white support, when compared to a "transmission view" type one-side coated film. In addition, a sensitivity equal to or higher than that of a "transmission view" type both-side coated film is obtained.

(3) When compared to a "reflection view" type black and white recording element, the range of density which can be used for observation is widened because of the decreased diffusion reflection and the increased maximum density, so that an excellent radiation image is obtained.

(4) The amount of silver used can be reduced markedly, as compared to a "transmission view" type both-side coated photographic film.

(5) A more advanced rapid processing system or simplified processing system can be employed because the thickness of the emulsion layer is thin due to the reduced amount of emulsion coated and, in addition, a water-proof support is used, when compared to a "transmission view" type both-side coated film.

(6) The radiation-recording element of the present invention can be exposed to radiation merely in combination with one fluorescent intensifying screen, since the radiation-recording element contains a support having a silver halide photographic emulsion coated on one surface thereof.

The following examples are given to illustrate the present invention in greater detail. Unless otherwise indicated, all parts, percents, ratios and the like are by weight.

EXAMPLE 1

Radiation-Recording Element I was prepared as follows.

To a mixture of 10 ml of a 4 percent by weight sodium hydroxide aqueous solution and 40 ml of water, was dissolved 2.5 g of a coupler having the formula as set forth below at 40° C.

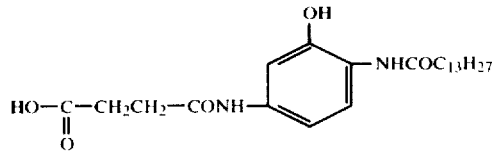

Separately, 6.5 ml of a 10 percent by weight citric acid aqueous solution was added to 83 g of an 8.0 percent by weight gelatin aqueous solution containing 0.034 mole of silver halide having a number average grain size of 1.1μ.

In order to prepare a photographic colloid solution, the above-described coupler solution was added to the thus obtained colloid solution and then the pH was adjusted to 6.5. To this solution, were added 4-hydroxy-6-methyl-1,3,3a,7-tetrazaindene as a stabilizing agent and 6.0 ml of a percent by weight sodium dichlorohydroxytriazine aqueous solution as a hardening agent. The thus obtained mixture was coated on a support having the composition as described below in an amount of 2 g of silver per square meter.

The support comprised a paper base, both surface of which had been laminated with polyethylene. In addition, of these laminated polyethylene layers on the paper base, the layer which was to carry thereon the above-described photographic emulsion contained titanium dioxide in an amount sufficient to provide a degree of reflection of 80 percent in the wavelength region of 380 mμ to 600 mμ, assuming that the degree of reflection of a magnesium oxide white plate was 100 percent.

A gelatin layer having a thickness of about 1.5μ was coated on the above-described silver halide photographic emulsion layer and then dried, to produce Radiation-Recording Element I. (The term "Radiation-Recording Element" is hereinafter referred to as "Recording Element" for brevity.)

Recording Element II was obtained using the same method as above to prepare Recording Element I, except for applying the same silver halide photographic emulsion as that of Recording Element I onto both surfaces of a transparent film support having a thickness of 180μ so as to provide a coating amount of 2 g of silver coated per square meter per side. In addition, Recording Element III was prepared by coating the same silver halide photographic emulsion as that of Recording Eoement I on one surface of the same transparent film support as that of Recording Element II in an amount of 4 g of silver coated per square meter.

The above-described Recording Elements I and III were each exposed to X-rays at a tube voltage of 50 KVp for various periods of time, using one sheet of a high sharpness type fluorescent intensifying screen containing potassium tungstate since these recording elements each had a coating of a silver halide photographic emulsion on only one side of the support. On the other hand, Recording Element II was exposed to X-rays in the same manner as described above, except two sheets of the fluorescent intensifying screen were employed since Recording Element II was a both-side coated film. In addition, a X-ray test chart which was made of lead metal was employed in order to measure the image sharpness.

Next, these recording elements were each processed with a developing solution and a fixing solution having the composition described below for 45 seconds at 35° C., respectively.

| Developing Solution | |
|---|---|
| Water | 800 ml |
| N-Hydroxyethyl-N-ethyl-p-phenylenediamine | 20 g |
| Sodium Sulfite (anhydrous) | 4 g |
| Potassium Bromide | 2 g |
| 5-Nitroisoindazole | 0.05 g |
| Sodium Carbonate | 40 g |
| pH (adjusted with NaOH) | 10.5 |
| Water to make | 1 l |

| Fixing Solution | |
|---|---|
| Sodium Thiosulfate (anhydrous) | 150 g |
| Sodium sulfite (anhydrous) | 15 g |
| Water to make | 1 l |

Blue images were each obtained by the above-described processing.

The sharpness of these images and the amounts of X-ray exposed (i.e., relative values based on the amounts of X-ray exposure required for a fixed density) are shown in Table 1 in Example 2 given hereinafter.

EXAMPLE 2

This Example demonstrates a specific embodiment of this invention where a sensitizing dye is further employed.

Recording Elements IV, V and VI were prepared in the same manner as for Recording Elements I, II and III, respectively, in Example 1, except that to the systems in Example 1 prior to addition of the stabilizing agent, a carbocyanine dye, sodium anhydro 5,6-dichloro-1-ethyl-5'-phenyl-3'-(4-sulfobutyl)-3-(3-sulfopropyl)-benzimidazoloxacarbocyanine hydroxide, was added in an amount of 0.4 g per mol of silver halide.

Recording Elements IV, V and VI were each combined with a green light-emitting type fluorescent intensifying screen containing $Gd_2O_2S$ activated with terbium in place of the high sharpness type fluorescent intensifying screen containing calcium tungstate used in Example 1 and were each exposed to X-rays followed by development and fixing in the same manner as in Example 1.

The image sharpness and the amount of X-ray exposure for these recording elements of Example 2 are shown in Table 1 along with the results obtained in Example 1.

Table 1

| Recording Element | Properties: Relative Image Sharpness (2 lines/mm) | Properties: Relative Amount of X-Ray Exposure |
|---|---|---|
| I | 120 | 75 |
| II | 100 | 100 |
| III | 120 | 250 |
| IV | 90 | 12 |
| V | 70 | 20 |
| VI | 80 | 50 |

Preferably, the sharpness obtained is as high as possible, whereas the amount of X-ray exposure is as low as possible.

It is apparent from the results illustrated above, that Recording Element I has a sharpness nearly equivalent to that of Recording Element III and in addition, requires only an amount of X-ray exposure approximately equivalent to or less than that for Recording Element II.

On the other hand, Recording Element IV which contains a sensitizing dye and which was used in combination with a green light-emitting type fluorescent intensifying screen requires only about a half of the amount of exposure to X-rays necessary for Recording Element V, while exhibiting a sharpness higher than that of Recording Element VI. This fact demonstrates the superiority of the recording method using Recording Element IV over the recording method using Recording Element I.

EXAMPLE 3

The maximum reflection densities of the image obtained on recording elements the same as Recording Element I as described in Example 1, except for employing a variety of silver coated amounts were measured using a densitometer having a spectral sensitivity approximating the visual sensitivity. The value of the density obtained is hereinafter referred to as "M.DV". The observed values of M.DV which were obtained by employing various amounts of coated silver are shown in Table 2 below.

The maximum reflection densities of the images obtained in Recording Element VII, which did not contain a coupler, by changing the amount of silver coated according to the method as described below were measured through a visual filter having a maximum absorption wavelength of about 550 nm. The values which were obtained are shown in Table 2 below.

Recording Element VII was prepared as follows.

To 120 g of a 4.7 percent by weight gelatin aqueous solution containing 0.076 mol of silver halide having a number average grain size of 1.2μ, were added 4-hydroxy-6-methyl-1,3,3a,7-tetrazaindene as a stabilizing agent and 1.0 ml of a 2 percent by weight sodium dichlorohydroxytriazine aqueous solution and then the thus obtained mixutre was coated on the same type of support using the same method as for Recording Element I, while changing the amount of silver coated per square meter.

The above-described recording elements were each exposed to X-rays in the same manner as for Recording Element I and then processed with a developing solution and a fixing solution having the composition set forth below for 45 seconds at 35° C., respectively.

| Developing Solution | |
|---|---|
| Water | 800 ml |
| Hydroquinone | 35 g |
| Phenidone | 0.6 g |
| Sodium Sulfite (anhydrous) | 100 g |
| Sodium Carbonate (anhydrous) | 25 g |
| Sodium Hydroxide | 21 g |
| Potassium Bromide | 1 g |
| Benzotriazole | 0.5 g |
| Water to make | 1 l |

| Fixing Solution | |
|---|---|
| Water | 600 ml |
| Sodium Thiosulfate (anhydrous) | 240 g |
| Sodium Sulfite (anhydrous) | 15 g |
| Acetic Acid (28% by wt. aq. soln.) | 48 ml |
| Boric Acid (crystals) | 7.5 g |
| Potassium Alum | 15 g |
| Water to make | 1 l |

Table 2

| Silver Amount ($g/m^2$) | M.DV (Maximum Density) | |
|---|---|---|
| | Recording Element I | Recording Element VII |
| 3.0 | 2.20 | 1.60 |
| 2.0 | 2.20 | 1.55 |
| 1.6 | 2.20 | 1.50 |
| 1.4 | 2.18 | — |
| 1.2 | 2.15 | — |
| 1.0 | 2.10 | 1.25 |
| 0.8 | 1.95 | — |
| 0.6 | 1.70 | — |
| 0.4 | 1.35 | — |

As is apparent from the results set forth above, Recording Element I containing about 0.5 g of silver per $m^2$ compares with Recording Element VII containing 1.6 g or more of silver per $m^2$.

EXAMPLE 4

Recording Element I as set forth in Example 1 was exposed to X-rays in combination with a fluorescent intensifying screen and then processed with a developing solution and a fixing solution having the composition as described below, respectively. As a result, a more rapid processing was possible due to the above-described system, and the drying speed was increased, when compared to the processing as set forth in Example 1.

| Developing Solution | |
|---|---|
| Water | 800 ml |
| Sodium Sulfite (anhydrous) | 2.0 g |
| N,N-Diethyl-p-phenylenediamine Sulfate | 4.0 g |

-continued

| Developing Solution | |
|---|---|
| Potassium Carbonate | 28.0 g |
| Potassium Bromide | 2.0 g |
| 5-Nitrobenzimidazole | 50 mg |
| 1-Phenyl-3-pyrazolidone | 0.1 g |
| Water to make | 1 l |
| pH (adjusted with KOH) | 10.4 |

| Fixing Solution | |
|---|---|
| Sodium Thiosulfate (anhydrous) | 150 g |
| Sodium Sulfite (anhydrous) | 15 g |
| Acetic Acid | 14 ml |
| Water to make | 1 l |

EXAMPLE 5

Onto a synthetic paper with a fine porous layer having a degree of reflection of 75 percent in the wavelength region of from 380 nm to 600 nm which was prepared by dipping a high impact polystyrene film support having a thickness of 200μ in acetone for 3 seconds and directly after that, dipping the support in water for 30 seconds followed by drying, was applied a coating of a silver halide photographic emulsion containing the same coupler as that employed in Example 1 so as to provide 2 g of silver coated per square meter. The thus obtained Recording Element VIII provided an image having improved sharpness both with an X-ray exposure amount approximately equal to that for Recording Element I and using the same processing conditions as those of Recording Element I.

EXAMPLE 6

1100 g of a high speed silver iodobromide photographic emulsion (AgI: 5.5 mol percent) obtained by reacting a molar equivalent amount of an alkali metal halide with 120 g of silver nitrate in the presence of 50 g of gelatin was mixed with 1000 g of an emulsion containing 67 g of Coupler (I), described below, and 67 g of gelatin and then dissolved at 40° C.

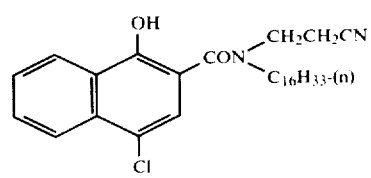

Coupler (I)

To this mixture, were added 4-hydroxy-6-methyl-1,3,3a,7-tetrazaindene as a stabilizing agent and 1.5 g of sodium dichlorohydroxytriazine and then the mixture was coated on the same type of support as that of Recording Element I so as to provide 2 g of silver coated per square meter. When the thus obtained Recording Element IX was processed, following exposure to X-rays, with a developing solution and a fixing solution having the composition as set forth below for 60 seconds at 35° C., respectively, an image having properties approximately equivalent to those of Recording Element I was obtained.

| Developing Solution | |
|---|---|
| N-Hydroxylethyl-N-ethyl-p-phenylenediamine | 12 g |

-continued

| Developing Solution | |
|---|---|
| Benzyl Alcohol | 10 g |
| Sodium Sulfite (anhydrous) | 4 g |
| Potassium Bromide | 2 g |
| 5-Nitroisoindazole | 0.05 g |
| Sodium Carbonate | 25 g |
| pH (adjusted with NaOH) | 10.5 g |
| Water to make | 1 l |

| Fixing Solution | |
|---|---|
| Sodium Thiosulfate (anhydrous) | 150 g |
| Sodium Sulfite (anhydrous) | 15 g |
| Water to make | 1 l |

COMPARATIVE EXAMPLE

A Fuji color paper manufactured by the Fuji Photo Film Co., Ltd. and Recording Elements I and IV were each exposed to radiation in combination with (a) a blue light-emitting type intensifying screen containing calcium tungstate or (b) a green light-emitting type intensifying screen containing a rare earth element (Fuji Green 6-4 Intensifying Screen, produced by the Fuji Photo Film Co., Ltd.), while varying the amount of radiation exposed. After that, the Fuji color paper was subjected to development processing with commercially available processing solutions for Fuji color paper whereas Recording Elements I and IV were processed with the ame processing solutions as set forth in Example 1.

The relative amounts of X-ray exposure to produce a fixed density are shown in Table 3 below.

Table 3

| Recording Element | Intensifying Screen | Relative Amount of X-ray Exposure |
|---|---|---|
| I | (a) | 75 |
| Fuji Color Paper | (a) | 750 |
| IV | (b) | 12 |
| Fuji Color Paper | (b) | 520 |

While the invention has been described in detail and with reference to specific embodiments thereof, it will be apparent to one skilled in the art that various changes and modifications can be made therein without departing from the spirit and scope thereof.

What is claimed is:

1. A method of recording a radiation image which comprises image-wise exposing to radiation, in combination with a fluorescent intensifying screen, a light-sensitive photographic element comprising a waterproof support, which has an average degree of reflection, based on the degree of reflection of a magnesium oxide white plate being 100%, of about 70 percent or greater in the spectral wavelength region of from about 380 mμ to about 600 mμ, and having on only one surface of the support a coating of a green sensitized silver halide photographic emulsion containing a phenolic color coupler or an α-naphtholic color coupler, each capable of forming a quinoneimine dye having a maximum absorption within a spectral wavelength region of about 550 mμ to about 700 mμ on color development, where the silver halide grains of the emulsion have a number average grain size of about 0.5μ to about 2.2μ and are present in an amount of from about 0.5 g to about 3 g of silver per $m^2$, and then subjecting the image-wise exposed light-sensitive photographic element to a color development processing with a phenylenediamine color developing agent and without a silver-removal step.

2. The method of claim 1, wherein said silver halide grains comprise grains of silver chloride, silver bromide, silver chlorobromide or silver iodobromide.

3. The method of claim 2, wherein said silver halide grains comprise grains of silver iodobromide containing about 10 mol % or less of silver iodide.

4. The method of claim 1, wherein said phenolic or said α-naphtholic color coupler is a color coupler having the general formulas (I) to (III)

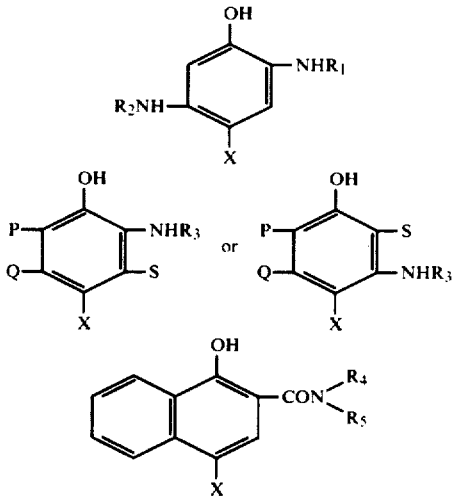

wherein $R_1$, $R_2$ and $R_3$, which may be the same or different, each represents an aliphatic carboxylic acyl group having 2 to 25 carbon atoms, an aromatic carboxylic acyl group having 7 to 30 carbon atoms, a heterocyclic carboxylic acyl group having 2 to 25 carbon atoms and 1 to 5 nitrogen atoms, oxygen atoms and sulfur atoms as hetero atoms, an aliphatic sulfonic acyl group having 1 to 25 carbon atoms, an aromatic sulfonic acyl group having 6 to 30 carbon atoms or an aliphatic carboxylic acyl group substituted with an aryloxy group having 7 to 30 carbon atoms; $R_4$ and $R_5$, which may be the same or different, each represents a hydrogen atom, an aryl group having 6 to 30 carbon atoms or an alkyl group having 1 to 25 carbon atoms; P, Q and S, which may be the same or different, each represents a hydrogen atom, a halogen atom, or an alkyl group having 1 to 10 carbon atoms; and X represents a substituent which is capable of being released on coupling.

5. The method of claim 1, wherein said fluorescent intensifying screen contains calcium tungstate, lead-barium sulfate or calcium tungstate/barium sulfate as a fluorescent material.

6. The method of claim 1, wherein said fluorescent intensifying screen is a fluorescent intensifying screen emitting radiation predominantly in the wavelength region of about 410 nm or longer and contains a fluorescent material radiating primarily in the green wavelength region of the spectrum.

7. The method of claim 1, wherein said image-wise exposing to radiation is by image-wise exposing to X-rays.

8. The method of claim 1, wherein said color development processing comprises color developing and fixing.

9. The method of claim 1, wherein said water-proof support comprises a paper base having coated on both surfaces thereof a layer of polystyrene, a polyester, polyethylene, polypropylene, a polyamide, a polycarbonate, polyvinyl chloride, a cellulose acetate resin, or a polyacetal, with one of said layers containing a white pigment incorporated therein.

10. The method of claim 1, wherein said water-proof support comprises a paper base having coated on both surfaces thereof a layer of a polyolefin resin containing a white pigment incorporated therein.

11. The method of claim 1, wherein said water-proof support comprises a transparent polymer support having coated on a surface thereof a layer of polyethylene, polypropylene, an ethylene-vinyl acetate copolymer, polyethylene terephthalate, a cellulose acetate resin or polyvinyl chloride containing a white pigment incorporated therein.

12. The method of claim 1, wherein said water-proof support comprises a film of a styrene resin as a main component and containing a white pigment incorporated therein.

13. The method of claim 12, wherein said styrene resin is polystyrene, an acrylonitrile-styrene copolymer, an acrylonitrile-styrene-butadiene copolymer, a methyl methacrylate-styrene copolymer, poly($\alpha$-methyl styrene) or a copolymer of $\alpha$-methyl styrene with another monomer copolymerizable therewith.

14. The method of claim 1, wherein said water-proof support comprises a film of a mixture of synthetic resins comprising a styrene resin in admixture with an ethylene-vinyl acetate copolymer, an ethylene-acrylate copolymer, an ethylene-methacrylate acid ionomer, an ethylene-acrylic acid ionomer, a butadiene-acrylonitrile copolymer, an ethylene-propylene copolymer, natural rubber, synthetic isoprene rubber, butadiene rubber, styrene-butadiene rubber, high styrene rubber, polybutadiene, chloroprene, polybutene, butyl rubber, nitrile rubber or a mixture thereof and said synthetic resin mixture contains a white pigment incorporated therein.

15. The method of claim 1, wherein said water-proof support comprises a polymer support having a roughened and whitened surface.

16. The method of claim 15, wherein said polymer is polystyrene, a polyester, a polyolefin, a polyamide, a polycarbonate, polyvinyl chloride, a cellulose acetate resin, or a polyacetal.

17. The method of claim 10, wherein said white pigment is titanium dioxide or zinc oxide.

18. The method of claim 17, wherein said white pigment additionally includes zinc sulfate, calcium sulfate, aluminum oxide, silicon oxide or barium sulfate.

19. The method of claim 11, wherein said white pigment is titanium dioxide, zinc oxide, calcium sulfate, barium sulfate, calcium carbonate, lithopone or a mixture thereof.

20. The method of claim 12, wherein said white pigment is titanium dioxide, barium sulfate, calcium sulfate, barium carbonate, lithopone, alumina white, calcium carbonate and silica white.

21. The method of claim 1, wherein said green sensitized silver halide photographic emulsion is the only emulsion present in said light-sensitive photographic element.

22. The method of claim 1, wherein due to the average degree of reflection of said water-proof support, during exposure multiple reflection of light is caused between said support and said fluorescent intensifying screen, whereby increased sensitivity results.

23. The method of claim 22, wherein said amount of silver halide grains, expressed as silver per $m^2$, is such as to decrease the terbidity of said silver halide photographic emulsion layer and to increase the efficiency of multiple reflection, thereby resulting in a decrease in the dosage required for imagewise exposure and a minimized deterioration in image-wise sharpness.

* * * * *